US011541561B2

(12) United States Patent
Drori

(10) Patent No.: US 11,541,561 B2
(45) Date of Patent: Jan. 3, 2023

(54) SHAVING IMPLEMENT

(71) Applicant: Edgewell Personal Care Brands, LLC, Chesterfield, MO (US)

(72) Inventor: Eran Drori, Los Angeles, CA (US)

(73) Assignee: EDGEWELL PERSONAL CARE BRANDS, LLC, Chesterfield, MO (US)

( * ) Notice: Subject to any disclaimer, the term of this patent is extended or adjusted under 35 U.S.C. 154(b) by 0 days.

(21) Appl. No.: 17/528,656

(22) Filed: Nov. 17, 2021

(65) Prior Publication Data

US 2022/0072725 A1 Mar. 10, 2022

Related U.S. Application Data

(60) Continuation of application No. 15/788,335, filed on Oct. 19, 2017, now abandoned, which is a division of application No. 14/994,470, filed on Jan. 13, 2016, now Pat. No. 9,919,441.

(51) Int. Cl.
*B26B 21/40* (2006.01)
*B26B 21/42* (2006.01)

(52) U.S. Cl.
CPC ..... *B26B 21/4018* (2013.01); *B26B 21/4037* (2013.01); *B26B 21/42* (2013.01)

(58) Field of Classification Search
CPC ... B26B 21/42; B26B 21/227; B26B 21/4037; B26B 21/40; B26B 21/522; B26B 19/3813
USPC ..... 30/47–51, 537–541, 200
See application file for complete search history.

(56) References Cited

U.S. PATENT DOCUMENTS

| | | | | |
|---|---|---|---|---|
| 2,234,440 | A | 3/1941 | Harrison | |
| 2,256,076 | A | 9/1941 | Coles | |
| 3,008,233 | A | 11/1961 | Waggoner | |
| 3,149,418 | A | 9/1964 | Milbourne | |
| 4,614,036 | A * | 9/1986 | Haraguchi | B26B 19/205 30/200 |
| 4,914,817 | A | 4/1990 | Galligan et al. | |
| 5,386,750 | A | 2/1995 | Morrison | |
| 8,015,710 | B1 | 9/2011 | Zyla | |
| 2008/0250644 | A1 | 10/2008 | Orloff et al. | |

(Continued)

FOREIGN PATENT DOCUMENTS

| | | |
|---|---|---|
| DE | 202005013297 | 12/2005 |
| EP | 2123409 | 11/2009 |
| FR | 2599657 | 12/1987 |

*Primary Examiner* — Nhat Chieu Q Do

(57) ABSTRACT

A shaving implement has a guard provided to fit over a blade retaining cartridge of a razor configured for wet shaving. The guard has a frame defined by top and bottom rails, spaced by first and second side edges, and elongated members defining a grate. The elongated members have outwardly extending barbs configured to arrange facial hair during a shaving process. The guard is secured over the blade retaining cartridge of the razor. When disposed over the blade retaining cartridge, the grate portion of the guard spaces any blades retained in the cartridge from the surface of a user's skin while still leaving such blades at least partially exposed to the user's facial or body hair. This enables a user to trim, rather than fully shave, his hair and further protects the user's skin from the harmful effects of close shaving.

11 Claims, 4 Drawing Sheets

(56) References Cited

U.S. PATENT DOCUMENTS

| | | | |
|---|---|---|---|
| 2015/0246454 | A1 | 9/2015 | Mintz et al. |
| 2018/0169879 | A1 | 6/2018 | Psimadas et al. |

* cited by examiner

SHAVING IMPLEMENT

CROSS REFERENCE TO RELATED APPLICATIONS

This application is a continuation of U.S. patent application Ser. No. 15/788,335, filed Oct. 19, 2017, which is a division of U.S. patent application Ser. No. 14/994,470, filed Jan. 13, 2016 now U.S. Pat. No. 9,919,441, the content of both being incorporated herein by reference.

TECHNICAL FIELD

The disclosed subject matter relates generally to shaving implements and, more particularly, to a removable guard for a wet-shave razor.

BACKGROUND

Safety razors, especially single or multi-blade refillable cartridge razors and single or multi-blade disposable razors, are popular for their ease of use and wide availability to shave facial and body hair. The number of blades on the razor is typically increased from one to about two or three or even four blades to achieve. Unfortunately, such razors are known to pose several risks and problems for users. For example, although aesthetically appealing, a close shave is the result of pulling hairs from their follicles to cut them beneath the surface of the skin. As the short hairs grow back, they may become trapped in the follicle beneath the surface of the skin. This is known to cause ingrown hairs and can lead to irritation and even infection in some instances.

Direct contact between the sharp edges of the razor blades and the users' skin is also known to cause uncomfortable and unsightly razor burn. When continuing to shave before textured razor burn has fully healed, users, especially new users such as teen boys, are liable to cut themselves.

Some solutions have been proposed to solve these problems. For instance, many advocate more traditional methods of shaving, such as use of double edged safety razors and straight razors, to avoid irritating the skin. This solution is deficient though because such razors are subject to travel restrictions and may be difficult to learn to use. Additionally, those with particularly coarse or curly hair may still experience irritation and ingrown hairs because the cut edges may not necessarily grow away from the user's skin.

It may instead be preferable to simply trim the hair shorter while not shaving it completely. Indeed, it may even be aesthetically preferable to trim the hair in this manner and leave what is commonly called a "five o'clock shadow," or stubble, on the face. As an example, U.S. Pat. No. 2,234,440 to Harrison teaches a comb attachment for trimming facial hair using a safety razor. The comb provided by this disclosure however, is only suited to trimming particularly long facial hairs as it is specifically formed to prevent cutting hair close to the skin. This would not be appropriate for creating a polished, short stubble appearance. Likewise, U.S. Pat. No. 5,386,750 to Morrison teaches a detachable hair-trimming attachment having teeth that extend above and perpendicular to the razor blade. Formed to slidably engage or clip with a razor head from the bottom of the razor head, this proposal is deficient because it must be particularly sized for a specific razor head in order to be properly secured to the razor head. And DE202005013297 to Bloemen et al. teaches a detachable trimmer for a wet safety razor that clamps onto a razor head by way of retaining units formed as snap-in pins that grip behind an edge of the razor. This proposal is deficient though because it is limited to use with razors adapted to receive snap-in pin retaining units.

Although various proposals have been made to solve the problem, none of those in existence combine the characteristics of the present invention. Therefore, there is a need for an improved guard for wet-shave razors.

SUMMARY

The present disclosure is directed to a guard for razors configured for wet shaving which prevents undesirable and possibly harmful effects of closely shaving with a single or multi-blade cartridge or disposable razor.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

In an embodiment, the guard comprises a frame portion, a grate portion, and means for compressibly mounting the frame to a blade-retaining portion of a razor. The frame portion may be defined by a top rail and a bottom rail vertically spaced by oppositely disposed first and second side walls. More particularly, each rail may have a front edge, rear edge, first side edge, and second side edge, and the first and second side wall may extend between each of the first and second side edges.

Next, the grate portion may be defined by a plurality of elongated members extending from and between each of the front edges of the top and bottom rails. The elongated members may also be horizontally spaced from one another to expose a hollow defined by the frame and grate portions that are integrated with one another.

The hollow may be particularly sized, owing to the dimensions of the rails and side walls, to receive a blade-retaining portion of a razor, chosen from any disposable and cartridge-type razors, so that the grate may be placed over any blades retained therein. Configured as such, the grate creates space between a user's skin and the blades so that direct contact between the skin and sharp edges of the blades is avoided. Still, because the elongated members defining the grate are horizontally spaced from one another, facial and body hair is still accessible to blades maintained behind the grate. Thus the hairs are still trimmable even with the razor guard secured in place. Indeed, grates having more or less depth into or out of the hollow may be provided as desired to affect trimming that results in a longer or shorter hair, respectively. One skilled in the art will recognize that the particular depth of the grate will not limit the wet-shave razor guard.

It is also contemplated that the top and bottom rails as well as the first and second side walls are neither necessarily straight, nor necessarily parallel to one another. One skilled in the art will recognize, for example, that slightly curved rails and side walls may better accommodate the dimensions of some blade-retaining portions of some razors than a strictly quadrilateral guard might. Changing the shape of the frame may allow users to retrofit a variety of different cartridge and disposable razors with the wet-shave razor guard. As one example, some razors may be better suited to or more closely fit with a guard having a frame that is approximately rectangular while others may be better suited to or more closely fit with a guard having a frame that is approximately trapezoidal. Likewise, it is contemplated that the shape of the frame may be particularly formed to receive a blade-retaining portion of a particular cartridge or disposable razor.

In some embodiments, each of the plurality of elongated members defining the grate may comprise a plurality of barbs to comb hairs as a user pulls a razor fitted with the razor guard across his face or other area of his or her body, such as arms legs and torso, while shaving. The barbs may ensure that the hair is neatly arranged during the shaving process so that each may be trimmed at about the same distance from the face or other ear of the body as each other hair, contributing overall to a neat and polished look. In some non-limiting embodiments, such barbs may be formed on an outside of each member and with pointed ends thereof facing downward toward the bottom rail. In other embodiments, such barbs may be formed alternatively or additionally on an inside of each member.

Finally, means for securely mounting the frame to a blade-retaining portion of a razor are provided. As such, the grate may be removably disposable in front of any blades retained in the razor. In one embodiment, a ridge is formed along the rear edge of at least one of the top and bottom rails. For example, a ridge may be formed along the rear edge of the bottom rail. In such embodiments, the top rail may be formed to curve downward toward the bottom rail to define a duct sized to envelop a top edge of the blade-retaining portion of the user's razor. Thus a user may place the duct around the top edge of the blade-retaining portion, then the bottom rail may be pressed along a bottom edge of the blade-retaining portion until the ridge securely claps said bottom edge. It is contemplated, however, that either or both of the top and bottom rails may comprise a ridge clipable to a blade-retaining portion formed thereon. Further, either the top or bottom rail may define a duct for enveloping a top or bottom edge, respectively of a blade-retaining portion. In any event, when a blade-retaining portion is securely disposed within the hollow defined by the frame and grates of the razor guard, the top and bottom rails and the first and second side walls may fully surround the blade-retaining portion.

It is one object of the invention to prevent irritable conditions caused by ingrown hairs and razor burn.

It is yet another object of the invention to protect any blades on a razor during travel.

It is still another object of the invention to provide a device to aid safely training users to shave.

Thus, it is another object of the invention to reduce friction between razor blade(s) and a user's skin to extend the life of the razor blade(s).

It is yet another object of the invention to enable wet trimming of existing facial or body hair.

One or more of the above-disclosed embodiments, in addition to certain alternatives, are provided in further detail below with reference to the attached figures. The disclosed subject matter is not, however, limited to any particular embodiment disclosed.

Figure 1:
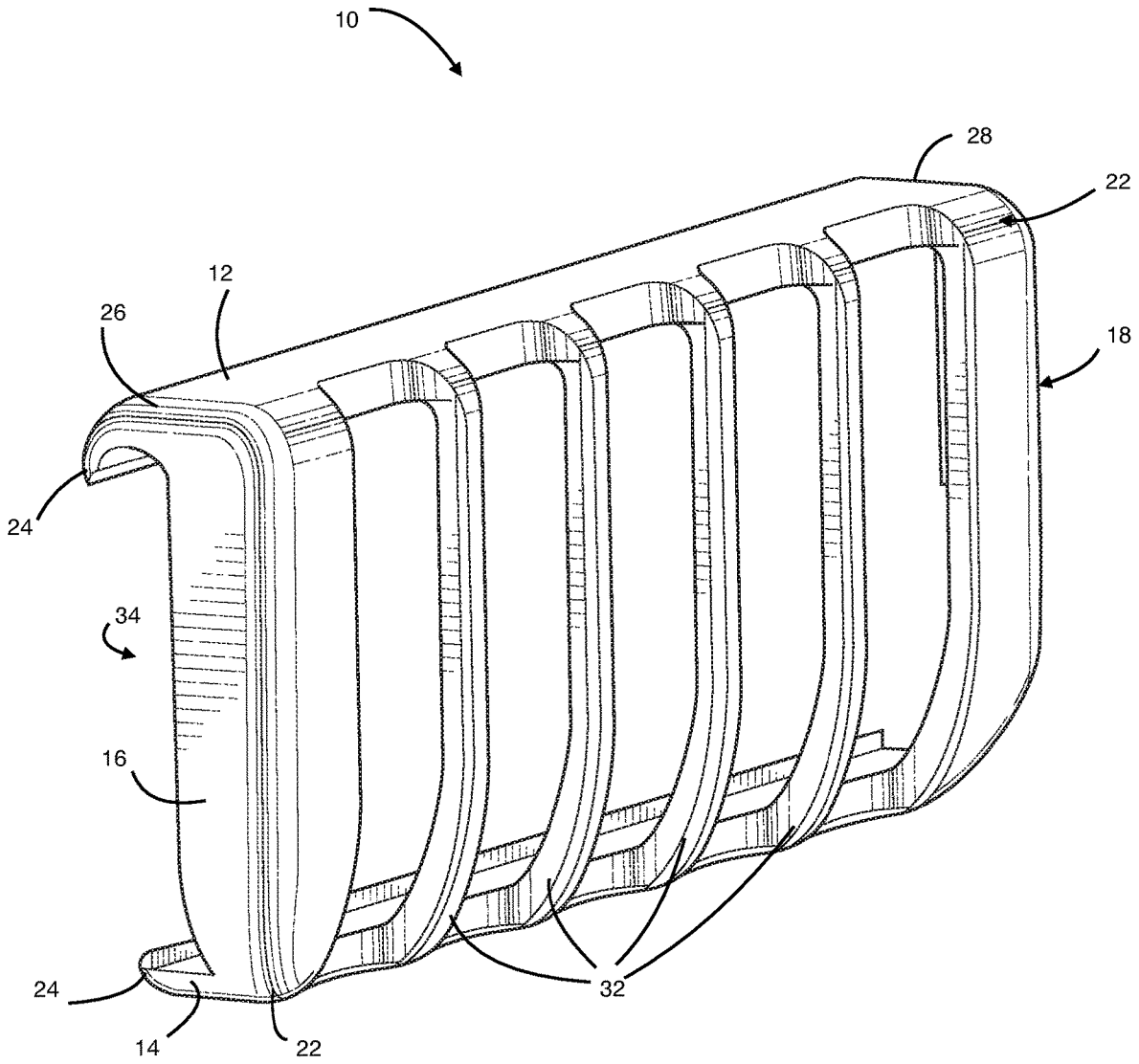
FIG. 1 shows a front perspective view of a razor guard in accordance with one embodiment of the invention.

The disclosed embodiments may be better understood by referring to the figures in the attached drawings, as provided below. The attached figures are provided as non-limiting examples for providing an enabling description of the apparatus claimed. Attention is called to the fact, however, that the appended drawings illustrate only typical embodiments of this invention and are therefore not to be considered as limiting of its scope. One skilled in the art will understand that the invention may be practiced without some of the details included in order to provide a thorough enabling description of such embodiments. Well-known structures and functions have not been shown or described in detail to avoid unnecessarily obscuring the description of the embodiments.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

With reference to FIG. 1 the razor guard 10 comprises a frame portion defined by a top rail 12 and a bottom rail 14 vertically spaced by oppositely disposed first and second side walls 16, 18. More particularly, each rail 12, 14 may have a front edge 22, rear edge 24, first side edge 26, and second side edge 28. The first and second side wall 16, 18 may extend from and between each of the first and second side edges 26, 28.

The grate portion of the razor guard may be defined by a plurality of elongated members 32 extending from and between each of the front edges 22 of the top and bottom rails 12, 14. The elongated members 32 may also be horizontally spaced from one another to expose a hollow defined by the frame and grate portions that are integrated with one another.

The corners of the frame, formed where the elongated members 32 seamlessly extend from the front edges 22 of the rails 12, 14 are shown as rounded, however, sharp corners are also contemplated. In some embodiments, rounded corners may enhance comfort to a user pulling the wet-shave razor guard fitted to a razor across his face, though. One skilled in the art will also recognize that although each element of the frame and grate are illustrated as seamlessly integrated with one another, each element may be adhered or attached to each other element respectively without departing from the invention.

The hollow 34 may be particularly sized, owing to the dimensions of the rails 12*b*, 14 and side walls, to receive a blade-retaining portion of a razor, chosen from any disposable and cartridge-type razors known on the market. Configured in this manner, the grate may be placed over any blades retained therein. Thus, the grate creates space between a user's skin and the blades so that direct contact between the skin and sharp edges of the blades is avoided. Still, because the elongated members 32 defining the grate are horizontally spaced from one another, facial and body hair is still accessible to blades maintained behind the grate. Thus the hairs are still trimmable even with the razor guard 10 secured in place. Indeed, grates having more or less depth into or out of the hollow may be provided as desired to affect trimming that results in a longer or shorter hair, respectively. One skilled in the art will recognize that the particular depth of the grate will not limit the wet-shave razor guard 10.

It is also contemplated that the top and bottom rails 12, 14 as well as the first and second side walls 16, 18 need not be straight or even parallel to one another to practice the invention. Although drawn so that the top and bottom rails 12, 14 and first and second side walls 16, 18 are straight and parallel, respectively, one skilled in the art will recognize, for example, that slightly curved rails and side walls are also contemplated. Indeed, curved side rails may accommodate the particular shape and/or dimension of some blade-retaining portions of some razors better than a strictly quadrilateral razor guard might. Altering the shape of the frame may allow users to retrofit a variety of different cartridge and disposable razors with the wet-shave razor guard 10. For example only and not for limitation, some razors may be better suited to or more closely fit with a razor guard 10 having a frame that is approximately rectangular while others may be better suited to or more closely fit with a guard having a frame that is approximately trapezoidal. Likewise, it is contemplated that the shape of the frame may be particularly formed to receive a blade-retaining portion of a particular cartridge or disposable razor.

Figure 2:
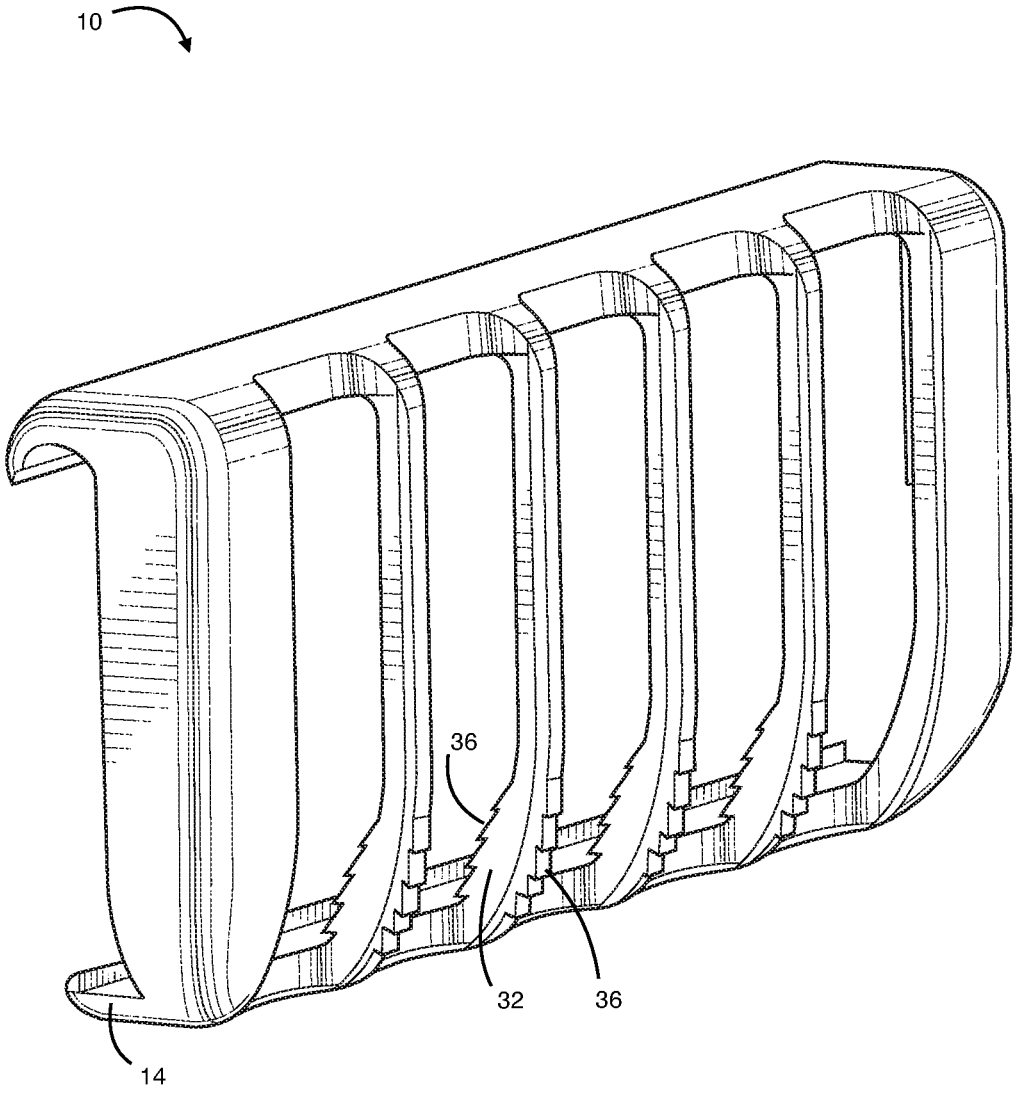
FIG. 2 shows a front perspective view of a razor guard in accordance with another embodiment of the invention.

Referring now to FIG. 2, each of the plurality of elongated members 32 defining the grate may comprise a plurality of barbs 36. Such barbs 36 may be provided to gently comb hair as a user pulls a razor fitted with the razor guard 10 across his face or other parts of his or her body while shaving. More particularly, the barbs 36 may ensure that the hair is neatly arranged during the shaving process so that each hair may be trimmed at about the same distance from the face as each other hair. It is contemplated that this may contribute overall to a neat and polished look even when a user wishes to maintain a short stubble or "five o'clock shadow". In some embodiments, such barbs 36 may be formed on an outside of each member 32 with pointed ends thereof facing downward toward the bottom rail 14. In other embodiments, such barbs 36 may be formed alternatively or additionally on an inside of each elongated member 32. In some embodiments, the barbs 36 may be formed along the entire length of each elongated member 32. In other embodiments, the barbs 36 may be formed along a portion, such as a lower portion illustrated in FIG. 2, of each elongated member 32, thus the particular arrangement of illustrated barbs 36 is offered by way of example only and not of limitation.

Figure 3:
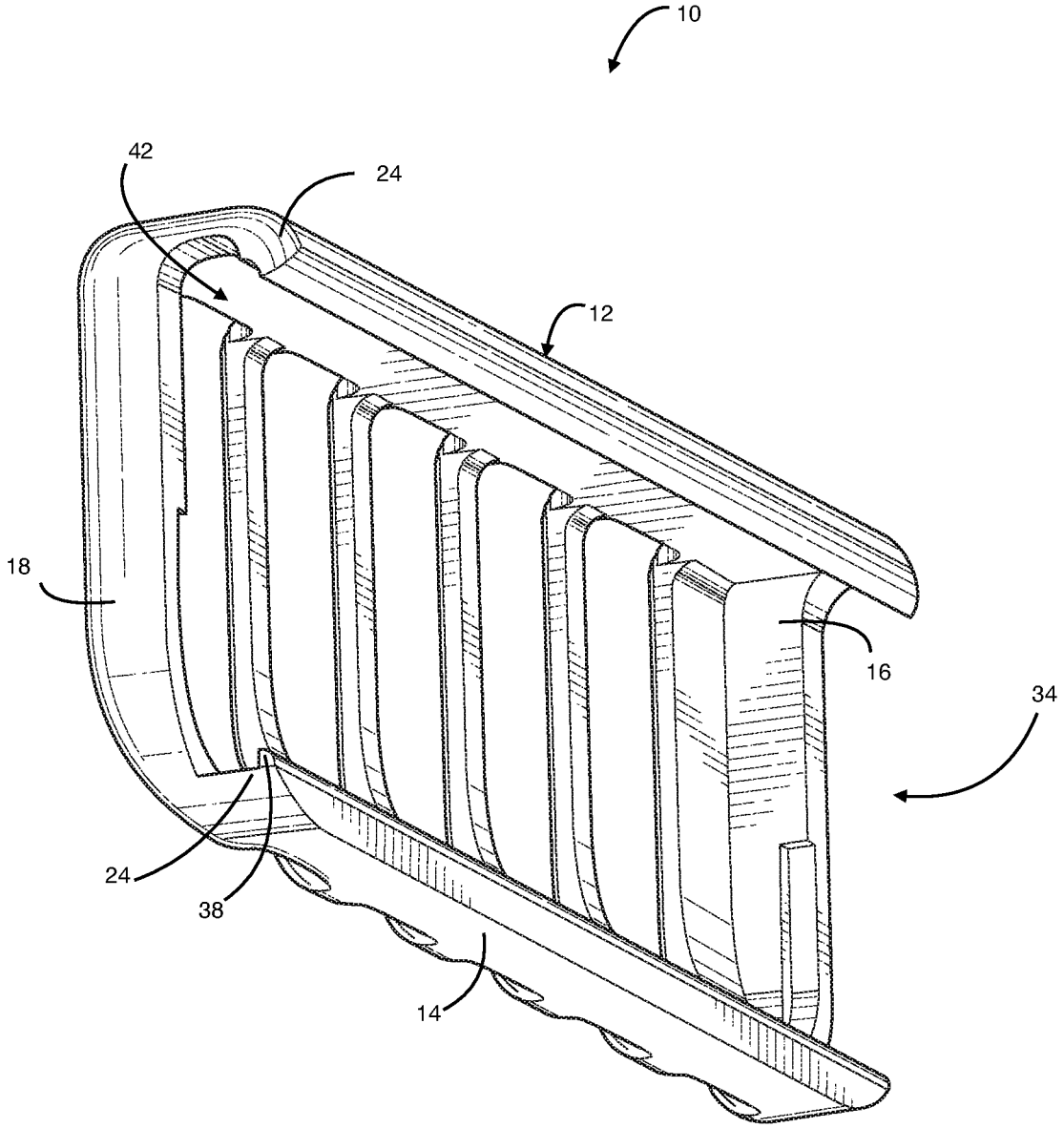
FIG. 3 shows a rear perspective view of a razor guard in accordance with one embodiment of the invention.
Figure 4A:
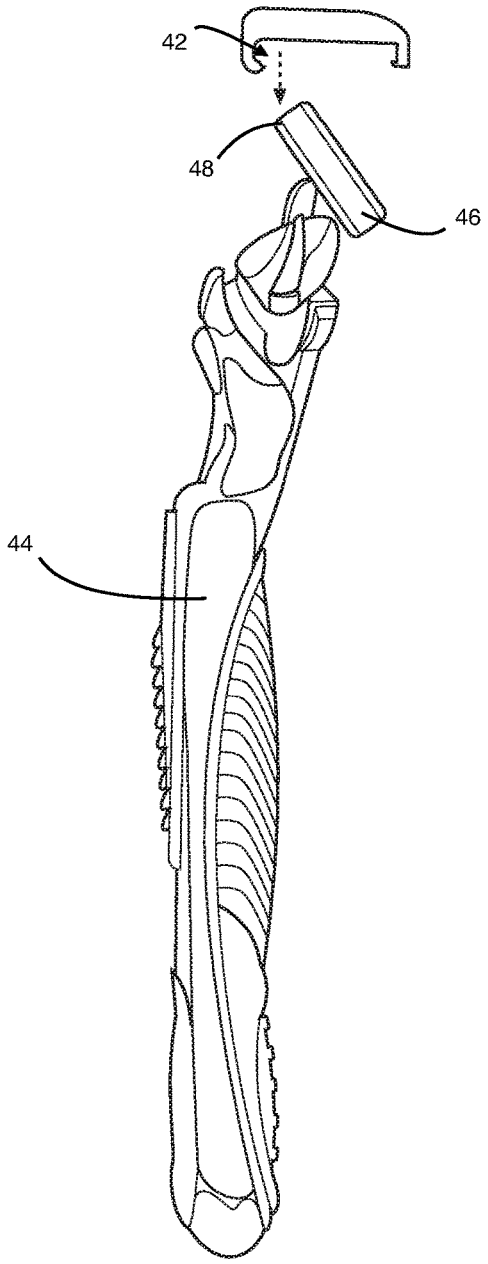
FIG. 4A-C illustrate a succession of plan views in which an embodiment of a razor guard is being secured to a blade-retention member.
Figure 4B:
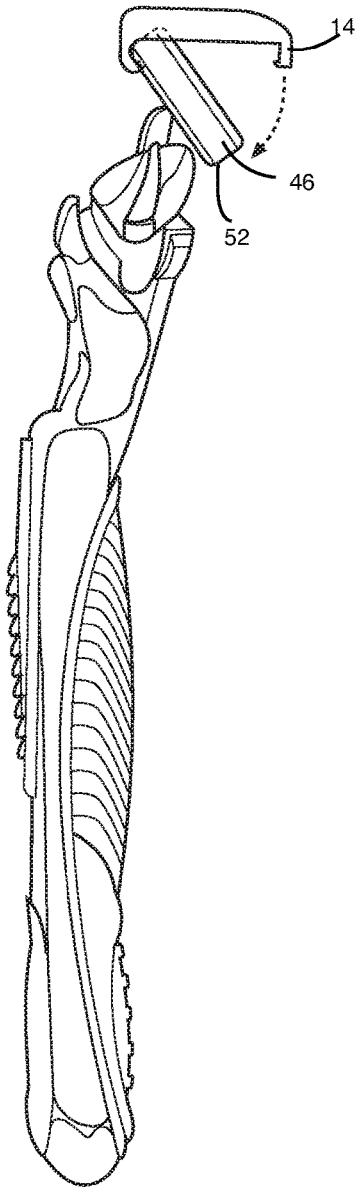
Figure 4C:
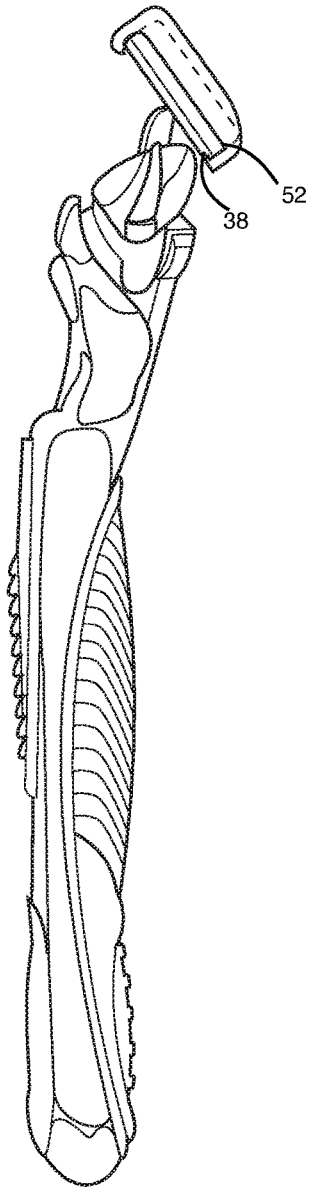

Means for securely mounting the frame to a blade-retaining portion of a razor are provided. This may be more clearly seen with reference to FIG. 3. In one embodiment, a ridge 38 is formed along the rear edge 24 of at least one of the top and bottom rails. As an example, in the illustration, the ridge 38 is be folioed along the rear edge 24 of the bottom rail 14. In such embodiments, the top rail 12 may be formed to curve downward toward the bottom rail to define a duct 42 sized to envelop a top edge of the blade-retaining portion of the user's razor. As such, the grate may be removably disposable in front of any blades retained in the razor. Thus, turning attention to FIGS. 4A through 4C one embodiment of a cartridge razor comprises a handle 44 and blade-retaining portion as a cartridge 46. Of course there are many types of razors available for use with the wet-shave razor guard 10, so it will be understood that the depiction of one type of razor is not intended to limit the invention but merely to illustrate an embodiment of it.

Then, a user may place the duct 42 around the top edge 48 of the blade-retaining portion, shown as a cartridge 46. Then, as in FIG. 4B, the bottom rail 14 may be pressed downward toward a bottom edge 52 of the cartridge 46 portion until the ridge 38 securely clasps around said bottom edge 52 as in FIG. 4C.

Returning to FIG. 3, it is contemplated, however, that either or both of the top and bottom rails 12, 14 may comprise a ridge 38 clipable to a blade-retaining portion of a razor. Further, either the top or bottom rail 12, 14 may be curved to define a duct 42 for enveloping a top or bottom edge, respectively, of a blade-retaining portion. In either orientation, it will be understood that when a blade-retaining portion is securely disposed within the hollow 34 defined by the frame and grates of the razor guard 10, the top and bottom rails 12, 14 and the first and second side walls 16, 18 may fully surround the blade-retaining portion.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. For example, the dimensions of the razor guard may be chosen depending on variables such as the size of a razor cartridge, and even how short a user wishes to trim his or her hair. Thus for example, the grates on the razor guard may be thinner or thicker to achieve a close shave or longer trim, respectively. Accordingly, it is intended that the invention not be limited, except as by the appended claim(s).

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the wet-shave razor guard with which that terminology is associated. In general, the terms used in the following claims should not be constructed to limit the wet-shave razor guard to the specific embodiments disclosed in the specification unless the above description section explicitly define such terms. Accordingly, the actual scope encompasses not only the disclosed embodiments, but also all equivalent ways of practicing or implementing the disclosed apparatus. The above description of embodiments of the wet-shave razor guard is not intended to be exhaustive or limited to the precise form disclosed above or to a particular field of usage.

While specific embodiments of, and examples for, the apparatus are described above for illustrative purposes, various equivalent modifications are possible for which those skilled in the relevant art will recognize.

While certain aspects of apparatus disclosed are presented below in particular claim forms, various aspects of the apparatus are contemplated in any number of claim forms. Thus, the inventor reserves the right to add additional claims after filing the application to pursue such additional claim forms for other aspects of the wet-shave razor guard.

The invention claimed is:

1. A shaving implement, comprising:

a wet shave razor having a handle and a blade retaining cartridge; and a unitary guard removably secured to the blade retaining cartridge, the guard comprising:

a frame portion having a top rail and a bottom rail, each rail having a front edge, a rear edge, a first side edge, and a second side edge, the top and the bottom rails being spaced in a first direction by a first and a second side wall extending respectively in a second direction from the first to the second side edges;

a grate portion integrally formed with the frame portion and being defined by at least a first elongated member and at least a second elongated member, each elongated member of the first elongated member and the second elongated member extending from the front edge of both of the top rail to the bottom rail, the first elongated member having a plurality of barbs formed on an outside of the first elongated member, the outside being opposite a hollow defined by the frame portion and the grate portion in combination, the hollow being sized to receive the blade retaining cartridge;

the barbs having pointed edges extending in the second direction, and the barbs facing generally towards the bottom rail and being positioned on the first elongated member closer to the bottom rail than to the top rail, the barbs being configured to arrange facial hair during a shaving process;

wherein the frame further comprises a ridge on the rear edge of the bottom rail extending into the hollow, and wherein the top rail extends towards the bottom rail to define a duct sized to envelope an edge of the blade retaining cartridge.

2. The shaving implement of claim 1, wherein the second elongated member is spaced from the first elongated member in the second direction.

3. The shaving implement of claim 2, wherein the second elongated member has a plurality of barbs formed on an outside of the second elongated member.

4. The shaving implement of claim 3, wherein the barbs of the second elongated member are aligned with the barbs of the first elongated member in the second direction.

5. The shaving implement of claim 1, wherein the guard is compressively secured to the blade retaining cartridge.

6. The shaving implement of claim 1, wherein the rails, edges, and first elongated member are integrated with one another to define a smooth outer surface and the barbs extend outwardly of the smooth surface.

7. The shaving implement of claim 1, wherein one of the top rail and the bottom rail is straight.

8. The shaving implement of claim 7, wherein the top rail and the bottom rail are parallel to one another.

9. The shaving implement of claim 1, wherein one of the first side wall and the second side wall is straight.

10. The shaving implement of claim 9, wherein the first side wall and the second side wall are parallel to one another.

11. The shaving implement of claim 1, wherein the second direction is generally perpendicular to the first direction.

* * * * *